US005607321A

United States Patent [19]

Schock et al.

[11] Patent Number: 5,607,321

[45] Date of Patent: Mar. 4, 1997

[54] CABLE PLUG CONNECTOR

[75] Inventors: Manfred Schock, Dreieich; Juergen Frommer, Fellbach; Manfred Illg, Weinstadt; Werner Pfitzenreiter, Lorch, all of Germany

[73] Assignee: ITT Corporation, New York, N.Y.

[21] Appl. No.: 545,748

[22] PCT Filed: Feb. 2, 1995

[86] PCT No.: PCT/EP95/00375

§ 371 Date: Jan. 16, 1996

§ 102(e) Date: Jan. 16, 1996

[87] PCT Pub. No.: WO95/24064

PCT Pub. Date: Sep. 8, 1995

[30] Foreign Application Priority Data

Mar. 1, 1994 [DE] Germany ..... 44 06 643.0

[51] Int. Cl.[6] ..... H01R 13/58

[52] U.S. Cl. ..... 439/460; 439/499; 439/606; 439/942; 29/865; 29/867

[58] Field of Search ..... 439/460, 465, 439/494, 499, 606, 942; 29/863, 865–867, 857

[56] References Cited

U.S. PATENT DOCUMENTS

| | | | |
|---|---|---|---|
| 3,252,644 | 5/1966 | Brent | 228/13 |
| 4,090,656 | 5/1978 | Sato et al. | 228/180 R |
| 5,203,717 | 4/1993 | Beck et al. | 439/460 |
| 5,244,397 | 9/1993 | Anhalt | 439/101 |
| 5,244,407 | 9/1993 | Volk et al. | 439/460 |

FOREIGN PATENT DOCUMENTS 429962 6/1991 European Pat. Off. .

*Primary Examiner*—Gary F. Paumen
*Attorney, Agent, or Firm*—Thomas L. Peterson

[57] ABSTRACT

In a process for fitting a round cable provided with a number of single wires with a multi-way, preferably flat, plug into which the single wires are placed, the single wires have their free ends stripped of insulation and are fitted with contacts. In such a process, assembly can be carried out in a cost-effective manner and the risk of damage to the small contacts is greatly reduced. Provision is made for the single wires to be placed alongside each other in a wire holder of the plug, for the ends projecting beyond the wire holder to be cut to the same projecting length and stripped of insulation to the same length and for a contact carrier to be provided with the corresponding number of adjacent contacts and connected to the end of the wire holder receiving the single wire ends, and for the opposing regions of stripped single wire ends and connection elements of the contacts to be interconnected to make electrical contact.

5 Claims, 3 Drawing Sheets

CABLE PLUG CONNECTOR

BACKGROUND OF THE INVENTION

The present invention relates to a process for fitting a cable provided with a number of single wires, preferably a round cable, with a multi-way, preferably flat, plug, and a cable connector employed in such a process.

In a known process of this type, the single wires exposed outside the cable sheath have their free ends stripped of insulation and are then connected to contacts supplied on a roll. If the contacts are provided with crimp connectors, the stripped ends of the single wires are placed on the crimp connectors and attached with the aid of a device (a crimping machine). The contacts are separated from each other at the same time. The individual cores are then inserted into a plug.

If the plug and thus the contacts become smaller, as is the case with PCMCIA cable plugs, the processing is very difficult. Moreover, the risk of damage to the contacts is greater when the parts become smaller. Often, the contacts can then only be fitted under the microscope, which is very costly. Furthermore, a high cost is incurred in ensuring the quality of the product. Since the exposed end regions of the cable are cut to the same length prior to insertion in the plug, stowage space must be available in the plug for the inner single wires, which in turn runs counter to desired miniaturisation.

The object of the present invention is therefore to create a process for fitting a cable with a plug of the type referred to above, which can be implemented in a more cost-effective manner and in which the risk of damaging the small contacts is greatly reduced. Moreover, a correspondingly very compact cable connector is to be provided.

SUMMARY OF THE INVENTION

In accordance with one embodiment of the invention, contacts are automatically pre-assembled in a cost-effective manner. Also, the cable preparation for connection to the individual contacts can be carried out more rapidly and more securely; the same applies to the connections of cable ends and contacts made possible with the aid of a machine. The risk of damage to the small contacts is minimized by their preassembly and their machine-made connection to the ends of the single wires. Furthermore, quality assurance is simplified so that a cable connector can be provided that is simple to manufacture and fit, which, among other things, is very compact because the cable end stowage space is unnecessary.

Cable preparation is simplified. A cover plate also covers the contact-making area and thus provides simultaneous protection.

The electrical contact between the stripped single wire elements and the connection elements of the contacts can, for example, be effected in one operation by means of soldering. The crimping can also be carried out in an advantageous way in one operation for all single wires simultaneously with the aid of a single tool.

The risk of a broken wire is considerably reduced. The above steps also ensure that the single wires are not flushed away by the high injection pressure during encapsulation.

Further particulars of the invention are disclosed in the following description in which the invention is described in further detail and explained with the aid of the exemplary embodiment illustrated in the drawing, where:

DESCRIPTION OF THE PREFERRED EMBODIMENT

The cable connector 10 illustrated in a preferred exemplary embodiment is provided in particular as a PCMCIA cable connector in which it is constructed with a number of poles and in a very compact form.

Figure 1A:
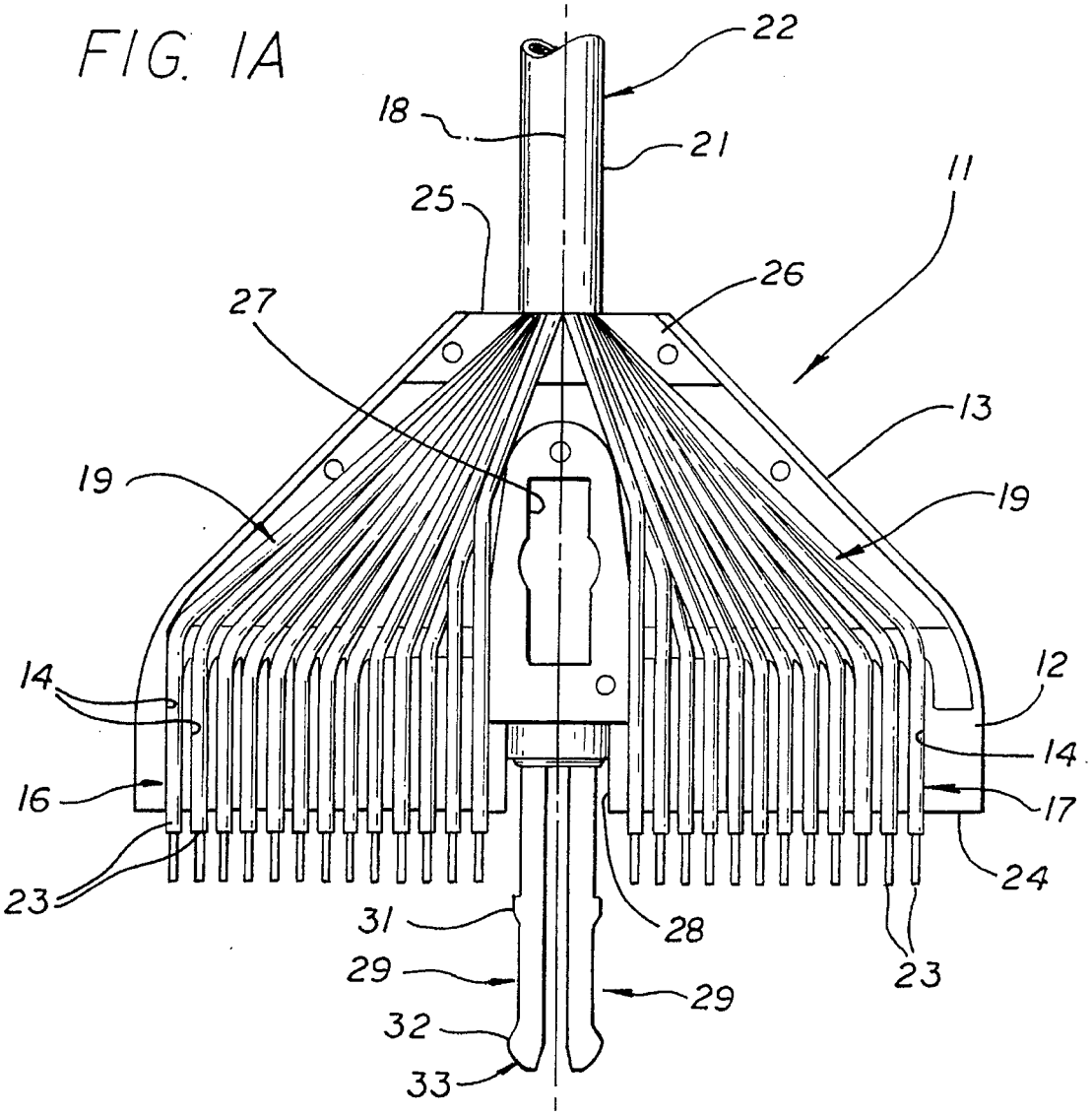
FIG. 1A is a partial plan view of an unassembled cable connector of the present invention, without the contact carrier.
Figure 2:
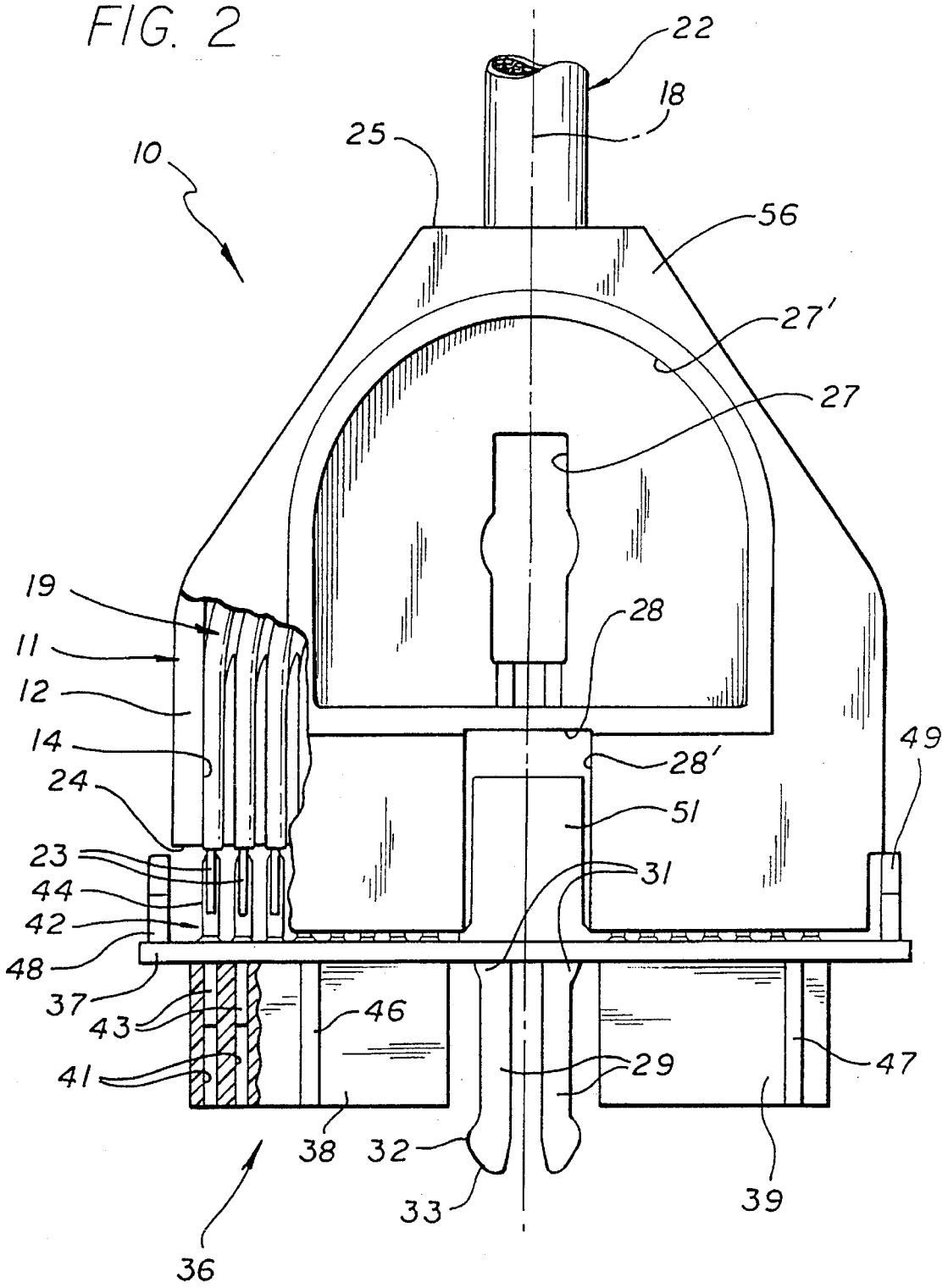
FIG. 2 is a partially cut-away plan view of the cable connector of FIG. 1A.

As FIG. 2 shows, the cable connector 10 has a wire holder 11 that is manufactured in one piece from plastic and whose upper side is open. As shown in FIG. 1A, the wire holder 11 has a front, approximately rectangular part 12 and a one-piece rear part 13 adjacent to it, which is of approximately trapezoidal shape. A number of parallel open channels 14 is provided in the rectangular part 12. Two groups 16, 17, in this case with differing numbers of channels 14, are provided on both sides of a central longitudinal plane 18. The end regions of single wires 19 freed from the sheath 21 of a multicore round cable 22 are inserted in the channels 14 so that the free ends 23 of the single wires 19 project over the front 24 of the wire holder 11. As can be seen from FIG. 1A, the single wires 19 run from the region of the cable 22 which ends at the rear edge 25 of the wire holder 11 and is provided with the sheath 21, radiating in straight lines through the trapezoidal part 13 of the wire holder 11 before they enter the channels 14 after bending. The channels 14 are provided with moulded, inward-facing projections, not shown, between which the single wires 19 are clamped. The wire holder 11 is very slim in the direction of the plane of the drawing, preferably slimmer than the diameter of the cable 22.

At the rear area of the trapezoidal part 13 a clamping web 26 spans the single wires 19 of the cable 22. The wire holder 11 is provided with a recess 27 and a shoulder 28 in the region of the central longitudinal plane 18. Two spring-loaded tabs which extend on either side of the central longitudinal plane 18 are moulded onto the base of the shoulder 28 and project well beyond the front face 24, and are provided with projections 31, 32 or a lead-in bevel 33, respectively, at a central longitudinal region and at the front end.

Furthermore, the cable connector 10 has a contact carrier 36 from whose strip 37 two long, rectangular, narrow connector webs (contact sleeve receptacles) 38, 39 project on either side of said central longitudinal plane 18. As FIG. 2 shows, the connector webs 38 and 39 are provided with parallel longitudinal holes which pass through the connector webs 38, 39 and the strip 37. The contact sleeves 43 of a number of contacts 42, whose connection elements 44 project from the rear side of the strip 37, are inserted into these longitudinal holes 41. As can be seen from FIG. 2, groups of closely-spaced, parallel, longitudinal holes 41 corresponding to the groups 16, 17 of the channels 14 in the wire holder 11, and corresponding groups of contacts 42 are provided. In the exemplary embodiment illustrated, the connection elements 44 are constructed in the form of crimp connections. The two connector webs 38, 39 (FIG. 1B) are each provided with a single rail or a pair of asymmetrically arranged rails 46, 47 for non-interchangeable insertion into an IC card, for example. Projecting stop webs 48, 49 are provided at both ends of the strip 37 parallel to the connection elements 44. Likewise, a sleeve 51 of rectangular cross-section and projecting to the rear, which can be locked via the two tabs 29, is moulded into the strip 37 in the region of the central longitudinal plane 18.

The free end regions of the single wires 19 of a cable 22 are fitted with the cable connector 10 in the following manner: Specific lengths of the end regions of the single wires 19 of the cable 22 are first freed from the sheath 21. The end regions of the single wires 19 are then laid straight in the trapezoidal part 13 and individually locked into the channels 14. The single wires 19 are placed into the wire holder 11 in such a way that a specific length of all free ends 23 projects over the front 24 of the wire holder 11. The free ends 23 are then cut off so that they project over the front 24 with a uniform length, as shown in FIG. 1A. The free ends 23 are then stripped of insulation over a specific length, preferably not the entire length projecting over the front 24. This state is illustrated in FIG. 1A.

Figure 1B:
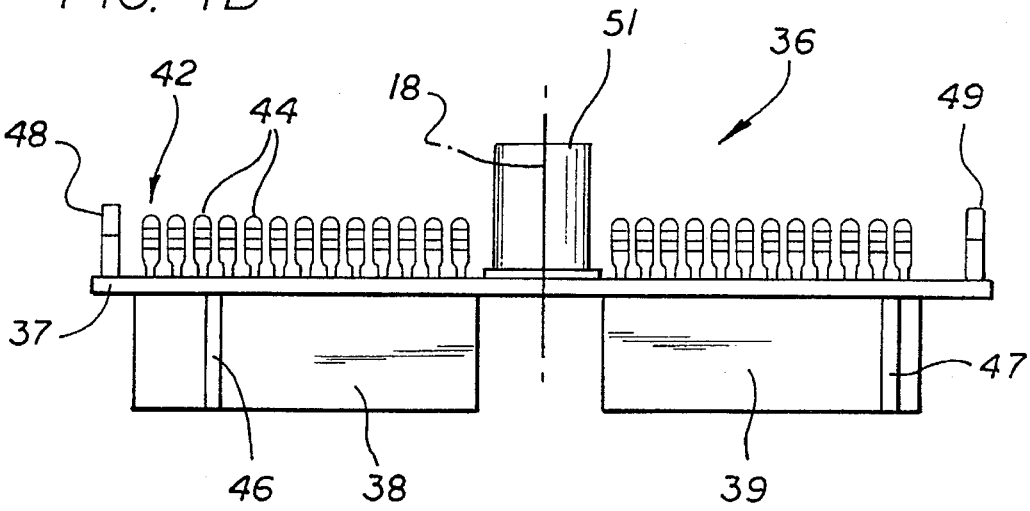
FIG. 1B is a plan view of a contact carrier of a cable connector, which can be assembled with the cable connector of FIG. 1A.

The contact carrier 36 is pre-assembled in the manner illustrated in FIG. 1B. The contact carrier 36, with its sleeve 51, is pushed over the tabs 29 and locked in the rear part of both tabs 29, as shown in FIG. 2. In this intermediate assembly step each stripped, free end 23 of the single wires 19 lies in the connection element 44 of a contact 42 or is immediately adjacent to it. The connection elements 44 are then processed with the aid of a single tool so that the stripped wire ends are crimped to the connection elements 44 of the contacts 42. It is obvious that it is also possible to solder the stripped free ends 23 of the single wires 19 to suitably constructed connection elements of the contacts 42 in one operation.

Furthermore, the cable connector 10 has a cover plate 56 which, as FIG. 2 shows, after the operation to make contact between the stripped ends of the single wires 23 and contact connection elements 44, is attached by locking to the wire holder 11. Here the cover plate 56 is of such shape and size that it completely covers the wire holder 11 and furthermore on the other side of the front 24 of the wire holder 11, essentially covers the areas of contact between single wire ends 23 and contact connection elements 44, as FIG. 2 shows. The cover plate 56 has a recess 27' and a shoulder 28' corresponding to the wire holder 11.

Figure 3:
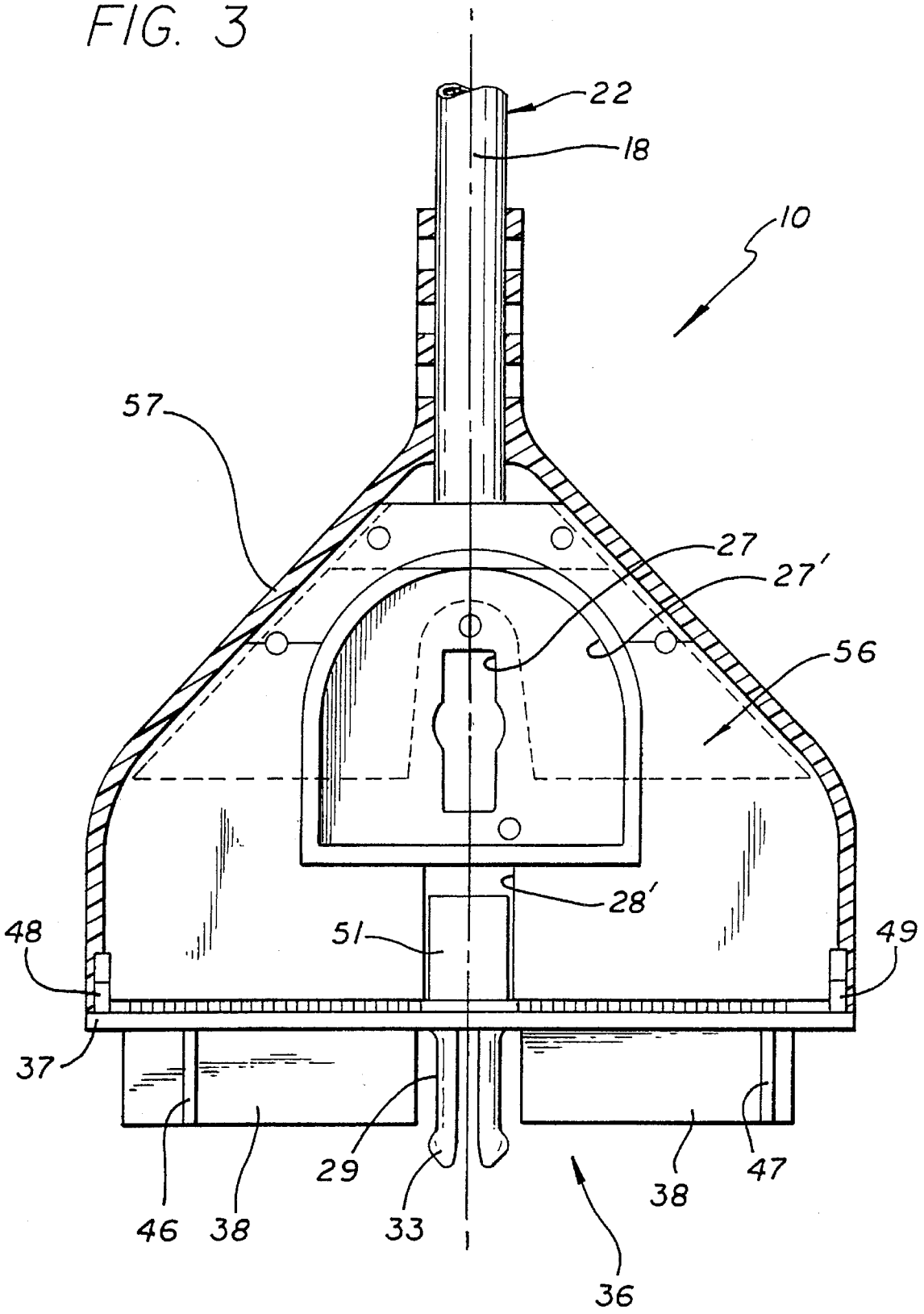
FIG. 3 is a plan view of the cable connector of FIG. 2 in the completed, plastic encapsulation state.

In a final operation, as FIG. 3 shows, the cable connector 10 connected to the cable 22 and assembled in this way is encapsulated in plastic so that a covering 57 is produced which extends from the strip 37 of the contact carrier 36 up to the cable 22. The covering 57 thus encloses the wire holder 11, the cover plate 56 and an area of the cable 22 with its sheath 21, bordering the cable connector 10. To limit the covering 57 up to the contact carrier 36, its strip 37 is constructed so that it projects all around the wire holder 11 and the cover plate 56 by the thickness of the covering 57 to be moulded on.

We claim:

1. A cable connector (10) comprising:

a cable (22) having a plurality of individual wires (19) with stripped ends (23);

a wire holder (11) having channels (14) for receiving said individual wires (19) of the cable (22), said channels constructed so the wires can be laid to project forwardly beyond a forward end of the holder;

a contact carrier (36) and a plurality of contacts (42) that each have a connection element (42), said contacts being mounted on the carrier, and said carrier being connected to the wire holder (11) so that the connection elements (44) of the contacts (42) and the stripped ends (23) of the single wires (19) are arranged immediately alongside each other;

a cover plate (56) which covers the wire holder (11) and the connection region between connection elements (44) of the contacts (42) and the stripped ends (23) of the individual wires (19).

2. A cable connector as claimed in claim 1, wherein:

said wire holder (11) has an appropriately rectangular front part (12) forming said channels (14), and has a rear, approximately trapezoidal part (13) joined to the front part (12) to form one piece.

3. A cable connector as claimed in claim 1, wherein:

the contact carrier (36) is locked to the wire holder (11).

4. A cable connector as claimed in claim 3, including:

a pair of spring-loaded tabs (29) fixed to said wire holder (11), and a sleeve (51) mounted on said contact carrier (36) and receiving said tabs (29, 30).

5. A cable connector as claimed in claims 1, wherein:

the wire holder (11), the contact-making region of the contact carrier (36) and a longitudinal region of the incoming cable (22) are encapsulated with a covering (57) of plastic.

* * * * *